United States Patent [19]

Koblenzer et al.

[11] Patent Number: 4,844,743

[45] Date of Patent: Jul. 4, 1989

[54] METHOD OF CLEANING WORKPIECES WITH A LIQUID SOLVENT

[75] Inventors: Heinz Koblenzer, Filderstadt; Peter Hösel, Pforzheim; Franz Staudinger, Berglen; Klaus Franke, Stuttgart, all of Fed. Rep. of Germany

[73] Assignees: LPW Reinigungstechnik GmbH, Filderstadt; Robert Bosch GmbH, Stuttgart, both of Fed. Rep. of Germany

[21] Appl. No.: 714,690

[22] Filed: Mar. 21, 1985

[30] Foreign Application Priority Data

Mar. 31, 1984 [DE] Fed. Rep. of Germany ..... 3412007

[51] Int. Cl.[4] ..... B08B 3/04; B08B 5/00

[52] U.S. Cl. ..... 134/11; 134/10; 134/25.1; 134/25.2; 134/25.4

[58] Field of Search ..... 134/11, 25.1, 25.2, 134/25.4, 10; 55/179, 163

[56] References Cited

U.S. PATENT DOCUMENTS

| | | | |
|---|---|---|---|
| 3,079,286 | 2/1963 | Kearney et al. | 134/12 |
| 3,144,872 | 8/1964 | Kearney | 134/12 |
| 3,460,990 | 8/1969 | Barday | 134/11 |
| 3,733,710 | 5/1973 | Kearney et al. | 134/11 |
| 4,023,983 | 5/1977 | Houke et al. | 134/11 |
| 4,074,984 | 2/1978 | Fuhring | 55/179 |
| 4,098,005 | 7/1978 | Wiarda | 134/11 |
| 4,101,340 | 7/1978 | Rand | 134/11 |
| 4,251,923 | 2/1981 | Kuri | 34/80 |
| 4,601,114 | 7/1986 | Noguchi | 34/80 |

*Primary Examiner*—Asok Pal

*Attorney, Agent, or Firm*—Lorusso & Loud

[57] ABSTRACT

A method and system for cleaning workpieces with a liquid solvent in a treatment chamber which is connected into a drying gas circuit for the purpose of drying the workpieces. The drying gas circuit includes in series one after the other a ventilator, a condenser, a heating device and an adsorber containing activated carbon. The circuit is operated such that during a drying phase the condenser is cooled, the heating device switched on and the activated carbon regenerated by the hot circulating air whereupon, during an adsorption phase with the condenser switched on and the heating device switched off, the remaining solvent vapor is withdrawn from the circulating drying air by the activated carbon.

10 Claims, 3 Drawing Sheets

METHOD OF CLEANING WORKPIECES WITH A LIQUID SOLVENT

FIELD OF THE INVENTION

The invention relates to a method for cleaning workpieces with a liquid solvent in a treatment chamber, with which the workpieces are dried, subsequent to cleaning, in a closed drying chamber by a flow of gas and at least part of the drying gas in a drying gas circuit is freed of part of the solvent carried along in vapor form by cooling in a condensation stage and fed back to the drying chamber and, in addition, an adsorption medium is used to adsorb solvent vapor resulting during drying. The solvents in question are solvents in which greasy, oily or other impurities may be dissolved.

DESCRIPTION OF THE ART

In a known method of the above-mentioned type (German laid-open application No. 32 05 736), the treatment chamber serves at the same time as drying chamber and is therefore integrated into the driving gas circuit which includes a condensation stage designed as a heat exchanger, a ventilator as well as a heating device also designed as a heat exchanger for heating the air circulated as drying gas. A return line for condensed solvent leads from the condensation stage to the treatment chamber. Installed in this chamber are solvent spraying nozzles which are component parts of a solvent circuit, i.e. the solvent is withdrawn from the bottom of the treatment chamber and conducted back to the spraying nozzles by a pump. Polluted solvent is withdrawn from the solvent circuit and regenerated by a distilling means.

Even when the condensation stage in the drying gas circuit is operated with low-temperature cooling, the treatment chamber still contains too much solvent vapor once drying has been completed, at any rate when the condensation stage is operated at temperatures which may be reached on an industrial scale at financially justifiable costs (the trichloroethylene, which is often used, still has, for example, at $-10°$ C. a saturation concentration of almost 100 g/m$^3$). For this reason, the drying gas circuit used for the known method is switched off after thw workpieces have been dried and the treatment chamber flushed with ambient air until the concentration of solvent in the treatment chamber falls below the maximum workplace concentration allowed. The air used to flush the treatment chamber, which is drawn in from the surrounding atmosphere, is exhausted through the roof. Prior thereto, it may be conducted through a condensation stage or over activated carbon to eliminate most of the solvent vapor comtained in it.

The known system is disadvantageous not only because it entails a relatively large and expensive construction for cleaning the waste air but also because the air sucked in from the surrounding atmosphere and used for cleaning the treatment chamber leads, in winter, to a loss in heating energy and the system may be operated so as to be free from emission only at great expense. As already mentioned, when the condensation stage is operated at justifiable costs only an insufficient amount of the solvent vapor is eliminated from the air used to flush the treatment chamber and an activated carbon adsorber must be filled after a relatively short time with fresh or regenerated activated carbon. In the conventional methods for regenerating activated carbon, water vapor is blown into the carbon and subsequently condensed in a condensation stage. Thus, the method to be improved by the invention has numerous disadvantages, such as a high vapor and, consequently, energy consumption. In addition, the solvent condenses with the water which makes it more difficult to use the solvent again and can also lead to waste water problems. Furthermore, there is also the risk of hydrolysis occurring when using a number of chlorinated hydrocarbons (e.g. 1.1.1 trichloroethane which is very often used). The activated carbon must also be predried again, after the hot vapor has been blow into it, before it can be reused in the adsorber. Finally, the air used to flush the treatment chamber contains atmospheric moisture which may be adsorbed and desorbed again with the solvent vapor but only when a water adsorber, such as for example a molecular sieve, is used (German laid-open application No. 31 39 369).

The object underlying the invention was to provide a method of the type described at the outset which may be carried out using a system which is simple in construction and operates without exhaust air and which consequently makes flushing of the treatment chamber or drying chamber with air unnecessary. This object is accomplished in accordance with the invention in that in a drying and desorption phase the drying gas in the drying gas circuit is conducted over a heated adsorption medium for the solvent vapor, following cooling and condensing of part of the solvent carried along, in order to draw off solvent vapor desorbed by the heated adsorption medium and to feed the same to the condensation stage, and that in an adsorption phase for further cleaning of the drying gas this gas is conducted in a cooled state over adsorption medium in the drying gas circuit. In the drying and desorption phase, not only is a large part of the solvent vapor carried along by the drying gas removed but the heated adsorption medium is also regenerated by the drying gas. In the subsequent adsorption phase, the solvent may therefore be removed by cool adsorption medium from the drying gas to such an extent that the workplace concentration in the drying chamber remains below the maximum limit and, consequently, the workpieces may be taken out. With the inventive method, the problematic regeneration of the adsorption medium by water vapor may be dispensed with, the apparatus is extremely simple in its construction and the adsorption medium to be used may be any adsorption medium which is effective for the solvent used and enables desorption, i.e. regeneration, to take place at higher temperatures. With the inventive method, the treatment chamber in which the workpieces are cleaned may, of course, be used as drying chamber. Activated carbon is particularly recommended as adsorption medium and a separate heating device for the adsorption medium could be provided for heating the adsorption medium for the purpose of desorption.

A great advantage of the inventive method is that is may be carried out without the problem of waste air and waste water.

It should be pointed out that it is known per se to regenerate activated carbon with hot air or hot inert gas (German patent specification No. 16 19 850). In this case, the air is conducted through the activated carbon in counterflow, the mixture of air and solvent vapor is subsequently burned off catalytically and the resulting hot stream of gas is partly conducted through the activated carbon again. In constrast, a system for carrying out the inventive method may do without much of the equipment necessary for the known method of regenerating adsorption medium, i.e. change-over valves and means for preparing (drying, cleaning and heating) the regeneration gas or the means for producing the water vapor used for desorption as well as for its separation from the desorbed solvent.

In a preferred embodiment of the inventive method, the adsorption medium for the desorption phase is not heated directly by a heating device but by the drying gas which is heated downstream of the condensation stage. In this way, not only is the adsorption medium evenly heated but the necessary conditions are also created for reusing the heat occurring in the condensation stage to heat the drying gas by means of a heater pump.

In order to cool the adsorption medium again during the adsorption phase and possibly recover solvent in the condensation stage, it is recommended that the drying gas be cooled in the condensation stage during the adsorption phase as well.

In principle, it would be possible to have the drying gas flowing through the drying gas circuit during the adsorption phase in the opposite direction to the direction of flow during the drying and desorption phase. It is, however, more favourable to select the same direction of flow for both phases so that the drying gas flows from the condensation stage to the adsorber via the heating device which is switched on or off.

In a preferred embodiment of the inventive cleaning method, this method is carried out in cycles each including a cleaning phase, during which the workpieces are cleaned, a drying and desorption phase as well as an adsorption phase and the workpieces are not removed from the closed room or treatment chamber until the adsorption phase has been completed. If a predetermined working cycle does not leave sufficient time for the adsorption medium to be completely regenerated during the drying phase, it is recommended that regeneration be commenced during the cleaning phase in that for desorption of the adsorption medium during the cleaning phase drying gas bypasses the treatment chamber and is conducted in the drying gas circuit over the heated adsorption medium and its solvent concentration reduced by subsequent cooling. This procedure merely requires a bypass line which is parallel to the treatment chamber and may be connected into the circuit or disconnected again.

The invention also creates a system for performing the aforesaid method which is based on a system comprising at least one closed treatment chamber for cleaning the workpieces with liquid solvent, a closed drying chamber for drying the cleaned workpieces, a drying gas circuit including the drying chamber and a cooler for the drying gas which is combined with a return pipe for condensed solvent and an adsorber receiving an adsorption medium for the solvent. The invention then proposes the arrangement of the adsorber and a heating device for heating the adsorption medium in the drying gas circuit between cooler and drying chamber. In a system of this type, only the heating device need be switched on and off to change over from the drying and desorption phase to the adsorption phase and vice versa and no valves or other control means are required. To recover heat during the drying and desorption phase, a preferred embodiment of the inventive system has a heater pump for coupling the cooler and the heating device with one another.

If the adsorption medium is to be regenerated, i.e. in the desorption phase of the inventive method, independently of the cycle time between loading and unloading of the treatment chamber or drying chamber, it is recommended that the inventive system be designed such that the drying gas circuit has a plurality of regeneration circuits adapted for selective connection into the drying gas circuit and comprising a drying gas circulating device, a cooler as well as a drying gas return line adapted to be shut by a valve for completion of the regeneration circuit.

Additional features, advantages and details of the invention are given in the attached claims and/or the following specification as well as the attached drawings of several preferred embodiments of the inventive system. FIGS. 1 to 3 are schematic illustrations of three different embodiments.

BRIEF SUMMARY OF THE DRAWINGS

FIG. 2 shows a plurality of treatment chambers and greater capacity adsorbers which allow a plurality of cleaning cycles.

The system of FIG. 1 has a treatment chamber 10 with a door 12 for loading and unloading. This door should be designed such that the treatment chamber is gas-tight when the door is closed. The treatment chamber includes a holder, which is not illustrated, for holding the workpieces to be cleaned. In FIG. 1, only one workpiece 14 is illustrated. This is sprayed with liquid solvent by spraying pipes 16 which are stationarily or displaceably held in the treatment chamber 10. The solvent flows over an intermediate bottom and through a valve 20 to a collecting chamber located therebelow. This collecting chamber includes a filter 22, beneath which a pipe 24 opens into the collecting chamber 21. The pipe 24 forms a solvent circuit with a pipe 28 including a pump 26 and a pipe 30 leading to the spraying pipes 16. The solvent may be regenerated by a distilling device 32 or the like, i.e. freed from oil and grease. This distilling device is connected with the solvent circuit via valves 34 and 36, a pipe 38 and a pump 40.

Figure 1:
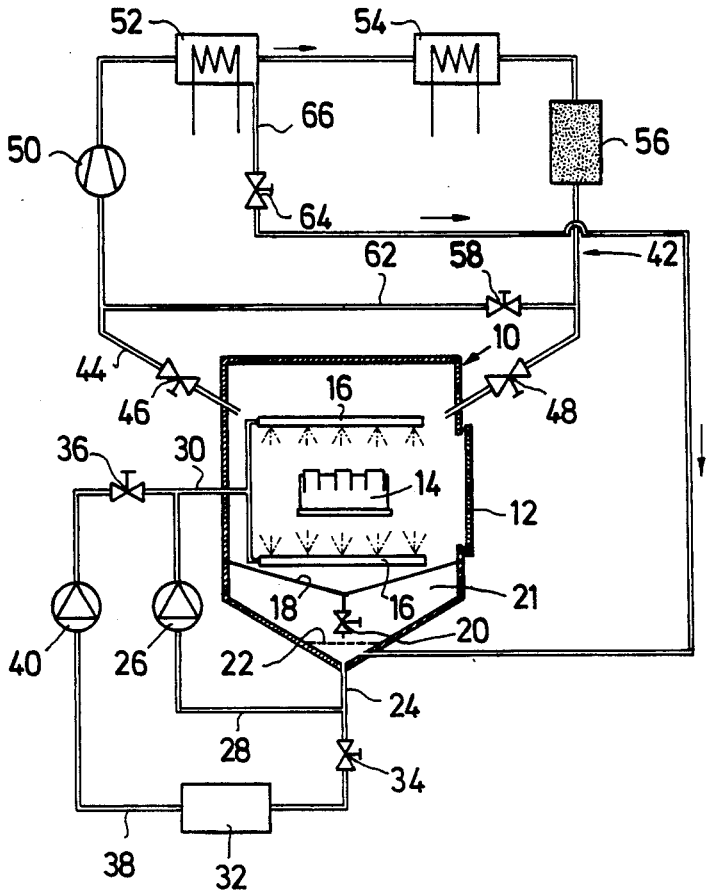
FIG. 1 is a schematic illustration of an entire cleaning circuit which shows one treatment chamber containing one workpiece.

A drying gas circuit designated as a whole as 42 is connected to the treatment chamber 10. This circuit comprises a pipe 44 with valves 46 and 48, both ends of this pipe opening onto the treatment chamber 10. A ventilator 50, a condenser 52, a heating device 54 and an adsorber 56 are arranged one after the other along the pipe. A bypass line 62 with a valve 58 is also provided so that when the drying gas circuit is operated with the valves 46 and 48 closed the treatment chamber 10 will be bypassed. A return line 66 with a valve 64 leads from the condenser 52 to the treatment chamber 10 so that the solvent condensed in the condenser 52 may be fed back into the solvent circuit. The adsorber 56 is intended to be filled with activated carbon.

Once the workpiece 14 has been sufficiently well cleaned, the pump 26 is switched off and the valve 20 closed once the solvent has drained out. When the valves 46 and 48 are open and the valve 58 closed, the ventilator 50, the cooling medium circuit, which includes the condenser 52 and is not illustrated in more detail, and the heating device 54 are then switched on. The air heated by the heating device 54 is blown against the workpiece 14 and adsorbs solvent vapor up to its saturation pressure. Most of the solvent vapor is condensed in the condenser 52, whereupon the air is reheated by the heating device 54 and the relative solvent vapaor concentration thereby reduced. The heated air heats the activated carbon contained in the adsorber 56 which is desorbed and thus regenerated by the air flowing through it. The solvent vapors set free by desorption in the adsorber 56 are partially condensed in the condenser 52.

After completion of the drying and desorption phase, the entire system has a solvent concentration which is determined by the temperature in the condenser 52. Before the door 12 is opened and the workpiece 14 removed from the treatment chamber 10, the solvent vapors still contained in the drying air circulated by the ventilator 50 are, for the most part, removed by the regenerated adsorber 56. The heating device 54 is hereby switched off but the condenser 52 is kept in operation in order to cool the adsorber 56 and the pipe system. The regenerated, activated carbon contained in the adsorber 56 then adsorbs the remaining solvent vapors. As soon as the solvent concentration in the recirculated air is below the maximum workplace concentration allowed the ventilator 50 is switched off and the workpiece may be removed from the treatment chamber.

The workpiece can, of course, be dried in a separate drying chamber which is joined to the treatment chamber 10 by a lock and is connected into the drying gas circuit 42.

If, for reasons of time, regeneration of the adsorber 56 is to be commenced while the workpiece 14 is still being cleaned, the valves 46 and 48 are closed and the valve 58 opened in order to circulate through the ventilator 50 the air which is heated by the heating device 54 and thus regenerates the activated carbon in the adsorber 56 while the solvent vapors are condensed in the condenser 52. Once the cleaning process has been completed, regeneration of the adsorber 56 may be continued during the drying phase.

Figure 2:
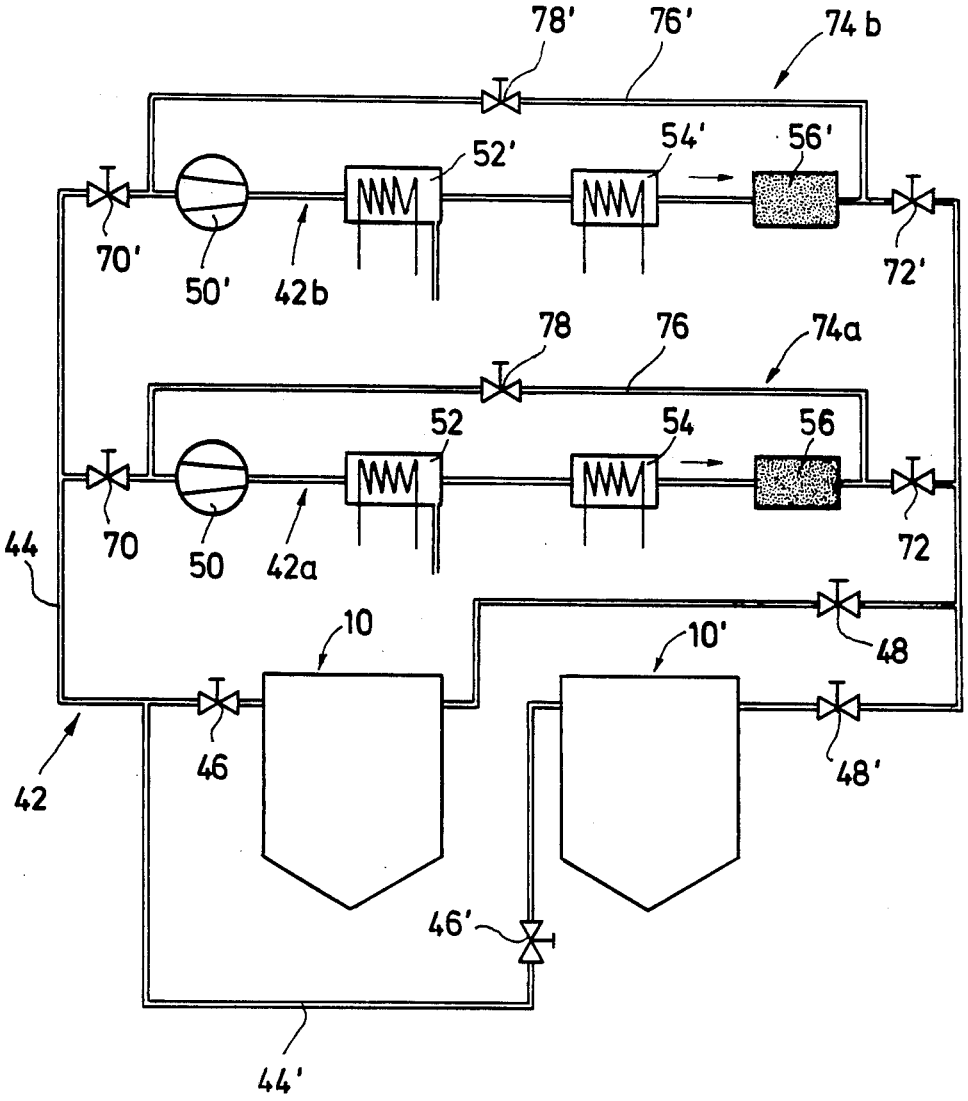
FIG. 2 is a schematic illustration of the cleaning circuit of the instant invention similar to that in FIG. 1 except

In FIG. 2, the same reference numerals have been used as in FIG. 1 insofar as the two systems are identical and so it is merely necessary in the following to describe the system of FIG. 2 in respect of the features which differ from the embodiment of FIG. 1.

The system has a drying gas circuit 42 connected to a treatment chamber 10 and including two branches **42*a* and 42*b* connected in parallel. These branches are connected to the treatment chamber 10 via a pipe 44 and valves 46, 48. Each of the branches 42*a*, 42*b* includes at its ends, valves 70, 72 or 70′, 72′, respectively, between which a ventilator 50 or 50′, a condenser 52 or 52′, a heating device 54 or 54′and an adsorber 56 or 56′ are placed in series, one after the other, in the direction of flow of the drying gas. In order to extend the two drying gas circuit branches 42*a*, 42*b* to form complete regeneration circuits 74*a* and 74*b*, pipes 76 and 76′ are provided which each include a valve 78 or 78′**, respectively.

Instead of the treatment chamber 10, another treatment chamber 10′ may also be connected into the drying gas circuit 42 via a pipe 44′ and valves 46′, 48′ for as long as the treatment chamber 10 is being emptied and loaded with new workpieces, the valves 46, 48 hereby being closed.

The advantage of the system illustrated in FIG. 2 over that of FIG. 1 is not only the fact that the adsorbers 56 and 56′ may be fully regenerated even when the cycle times for the drying phase are relatively short, e.g. because a plurality of treatment chambers are used, but also its energy saving. In the system as illustrated in FIG. 1, the adsorber must be heated and cooled again in short time intervals. A system of the type shown in FIG. 2 facilitates use of adsorbers 56 or 56′ having a greater capacity and so each adsorber adsorbs solvent vapor or is regenerated throughout a plurality of cleaning cycles. It is therefore possible, first of all, to use the branch **42*a* for the drying and desorption phases of a plurality of cleaning cycles, the adsorption phases of which are switched over to the branch 42*b*; during the cleaning cycles the adsorber 56 is regenerated via the regeneration circuit 74*a*. Following a number of cleaning cycles, drying and desorption is then carried out via the branch 42*b* and adsorption via the branch 42*a*, the adsorber 56′ being simultaneously regenerated via the regeneration circuit 74*b***.

The solvent recovered in the coolers or condensers 52 and 52′ of the system shown in FIG. 2 is, of course, fed back to collecting chambers 21 of the treatment chambers 10 and 10′ which are not illustrated in FIG. 2.

Figure 3:
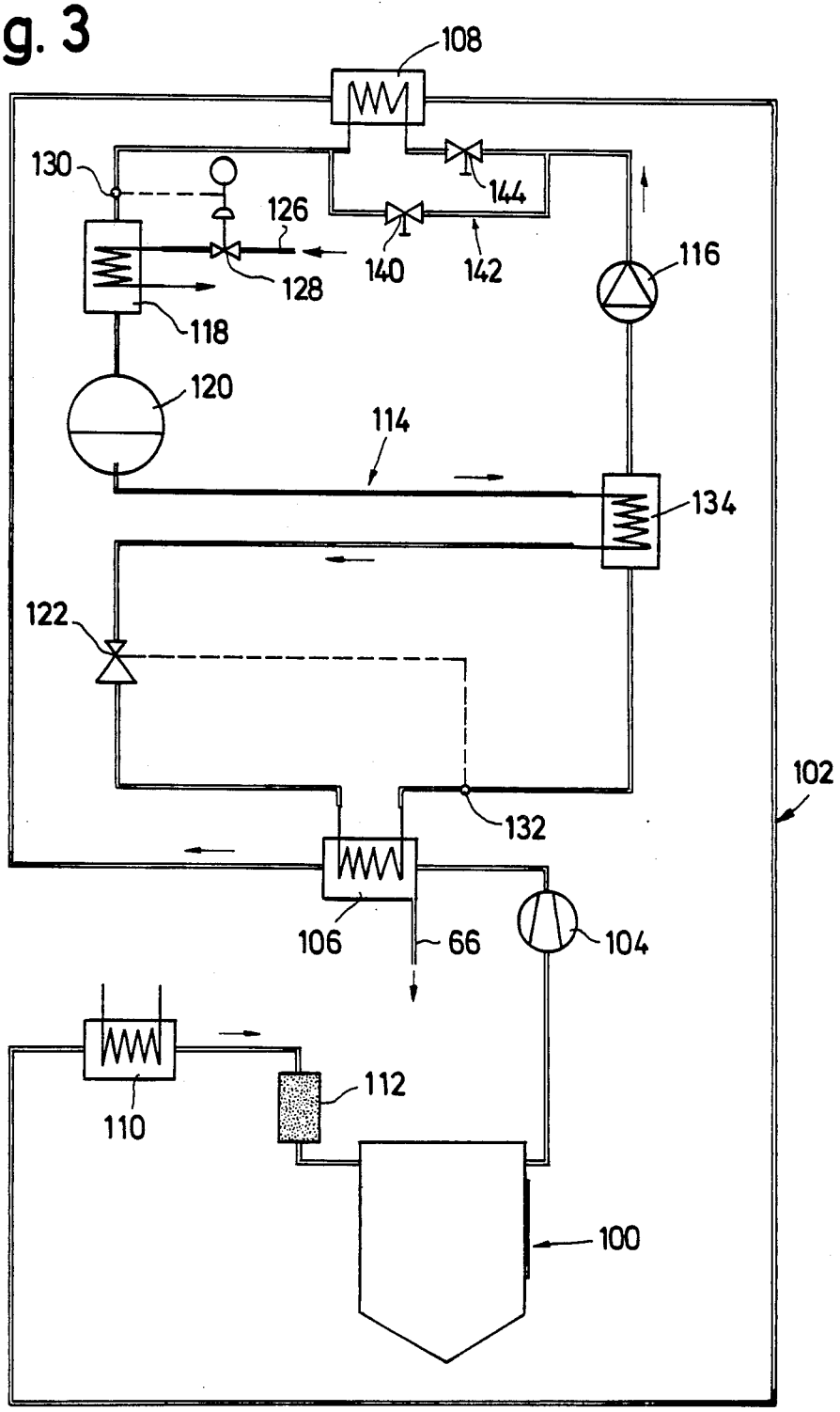
FIG. 3 is a detailed schematic illustration of the circuit for recovering heat from the condensation stage as well as a detailed schematic illustration of the coolant circuit.

The system of FIG. 3 contains means for recovering heat from the condensation stage for the purpose of heating the air circulating in the drying gas circuit and, therewith, the adsorber for regeneration.

A treatment chamber 100 is again connected into a drying gas circuit 102 which, starting from the treatment chamber, includes one after the other a ventilator 104, a condenser 106, a heating device 108, an additional electric heating device 110 and an adsorber 112. Liquid solvent recovered in the condenser 106 may again be fed back via a return line 66 to a corresponding room beneath the treatment chamber 100 which corresponds to the collecting chamber 21 of the embodiment of FIG. 1.

In addition, a coolant circuit 114 is provided which includes the condenser 106 as evaporator and the heating device 108 as liquefier. Furthermore, the coolant circuit 114 is also provided with a compressor 116 and, following this in series for the coolant, an aftercooler 118, a collecting tank 120 and a throttle valve 122 located upstream of the condenser 106 serving as evaporator. The aftercooler 118 is supplied with cooled water or cooled air via a coolant line 126. The coolant line includes a valve 128 which is temperature-dependently controlled by a temperature gauge 130. Moreover, a temperature gauge 132 is provided in the coolant circuit 114 downstream of the condenser 106 serving as evaporator in order to be able to control the throttle valve 122 in response to temperature. A complementary evaporator, which is designated 134 and is designed as a heat exchanger for the coolant, serves to cool even further the liquid coolant located downstream of the collecting tank 120.

To prevent the drying air being heated by the liquefier 108 during the adsorption phase, this liquefier may be bypassed by a bypass line 142 provided with a valve 140. In addition, a valve 144 is provided for this purpose in the coolant circuit 114 upstream of the liquefier 108.

What is claimed is:

1. Method for drying a workpiece being cleaned by a solvent and housed in a chamber, by circulating a drying gas through a drying gas circuit comprising said chamber, a condensation stage and an adsorption medium for vapor of said solvent picked up by the drying gas from said workpiece, the method comprising the following steps:

(a) in a simultaneous drying and desorption phase circulating drying gas through said chamber, through an active condensation stage and over a heated adsorption medium and simultaneously cooling the drying gas in said condensation stage and heating said adsorption medium such that solvent vapor is desorbed by said adsorption medium and that at least a portion of the solvent vapor picked up by the drying gas from the workpiece and from the adsorption medium is condensed in the condensation stage;

(b) after partially removing solvent vapor from the drying gas by condensation, in an adsorption phase the drying gas is conducted over cool adsorption medium for further removal of solvent vapor from the drying gas, and (c) regenerating the adsorption medium used in said adsorption phase by heating said adsorption medium and circulating drying gas over said heated adsorption medium and through an active condensation stage in which the drying gas is cooled for condensation of the solvent vapor desorbed by said heated adsorption medium.

2. Method as defined in claim 1 wherein for the desorption phase the adsorption medium is heated by the drying gas being heated downstream of the condensation stage.

3. Method as defined in claim 1 wherein during the adsorption phase the drying gas is also cooled in the condensation stage.

4. Method as defined in claim 1 wherein during the adsorption phase the drying gas passes through the drying gas circuit in the same direction as in the drying and desorption phase.

5. Method as defined in claim 1 wherein the workpieces are not removed from the drying chamber until after the adsorption phase.

6. Method as defined in claim 1 wherein the cleaning method is performed in cycles each including a cleaning phase, during which the workpieces are cleaned, a drying and desorption phase as well as an adsorption phase.

7. Method as defined in claim 1 wherein for desorption of the adsorption medium during the cleaning phase drying gas bypasses the treatment chamber and is conducted in the drying gas circuit over the heated adsorption medium and its solvent concentration reduced by subsequent cooling.

8. Method as defined in claim 1 wherein heat from the condensation stage returns to that zone of the drying gas circuit in which the drying gas or adsorption medium is heated.

9. Method according to claim 1, wherein the same adsorption medium is used in the drying and desorption phase and in the adsorption phase.

10. Method according to claim 1, wherein the drying gas circuit comprises said chamber so that the drying gas is flowing over the workpiece during the drying and desorption phase.

* * * * *